United States Patent [19]

Widmer

[11] 4,055,944

[45] Nov. 1, 1977

[54] SECURING DEVICE FOR THE OUTER END OF THE HAIR-SPRING OF A TIMEPIECE

[75] Inventor: Rene Widmer, Fontainemelon, Switzerland

[73] Assignee: Fabrique d'Horlogerie de Fontainemelon S.A., Fontainemelon, Switzerland

[21] Appl. No.: 689,089

[22] Filed: May 24, 1976

[30] Foreign Application Priority Data

June 18, 1975 Switzerland ..... 7900/75

[51] Int. Cl.[2] ..... G04B 17/32

[52] U.S. Cl. ..... 58/115; 58/109

[58] Field of Search ..... 58/109, 114, 115

[56] References Cited

U.S. PATENT DOCUMENTS

| | | | |
|---|---|---|---|
| 3,154,912 | 11/1964 | Pinkas | 58/115 |
| 3,328,955 | 7/1967 | Schneider | 58/115 |
| 3,943,701 | 3/1976 | Poix | 58/109 |

FOREIGN PATENT DOCUMENTS

| | | | |
|---|---|---|---|
| 1,145,347 | 1/1957 | France | 58/115 |
| 2,318,436 | 11/1973 | Germany | 58/115 |

*Primary Examiner*—Robert K. Schaefer
*Assistant Examiner*—Vit W. Miska
*Attorney, Agent, or Firm*—St. Onge, Mayers, Steward & Reens

[57] ABSTRACT

A securing device which permits the outer end of the hair-spring in a timepiece to be fastened either by gluing or pinning it in place. A U-shaped arm extends radially of the axis of the balance wheel and provides a pair of ears, one for gluing the hair-spring and the other for pinning it. The manufacturer of the watch can thus use the ear for gluing the outer end of the hair-spring, as this method has advantages for production purposes. When the hair-spring is replaced, the watch-repairman can use the other ear for pinning the outer end of the hair-spring without deforming the hair-spring, thereby obtaining the advantages of this method for repair purposes.

2 Claims, 5 Drawing Figures

SECURING DEVICE FOR THE OUTER END OF THE HAIR-SPRING OF A TIMEPIECE

BACKGROUND OF THE INVENTION

The present invention relates to a securing device for the outer end of the hair-spring of the balance wheel of a timepiece.

It is admitted that gluing the outer end of a hair-spring for a timepiece provides some advantages, especially in the rapidity of the operation of securing the hair-spring in mass production, in the absence of deformation of the hair-spring and in the risk of damage thereto.

However, gluing hair-springs also has some drawbacks, more particularly in repairing them, due to the fact that the people who do this work are not usually provided with the material or equipment needed for this operation.

The object of the present invention is to furnish means permitting the manufacturer to glue the hair-spring and, consequently, to take advantage of this method of securing, especially where mass production is concerned, but which also allows the hair-spring to be secured in another way, namely by means of a pin, thereby overcoming the drawback mentioned hereinabove concerning the repairing, the person doing the repair thus having at his disposal another securing means for the hair-spring.

SUMMARY OF THE INVENTION

The invention resides in providing a securing device for the outer end of the hair-spring in a watch or other timepiece with a U-shaped arm which extends radially of the axis of the balance wheel. Two thin-walled ears formed by the parallel legs of the U-shaped arm are disposed parallel to the axis of the balance wheel at a predetermined angle to the radial plane extending through the middle of the arm. One of the ears is provided with an opening, such as a notch, for gluing the outer end of the hair-spring, while the other ear has a second opening, such as a circular hole, to receive and fix the end off the hair-spring by means of a pin when it is not glued in the first opening. The ear for pinning is situated on a radial plane through the axis of the balance wheel such that the plane of the second opening is perpendicular to the tangent to the hair-spring at the point where it is pinned.

DETAILED DESCRIPTION OF PREFERRED EMBODIMENT

The drawing shows, by way of example, one embodiment of the invention.

Figure 1:
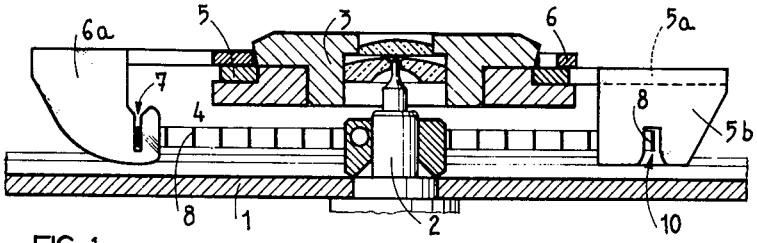
FIG. 1 is an axial sectional view of a portion of a regulating device for a timepiece, including the balance wheel and hair-spring.
Figure 2:
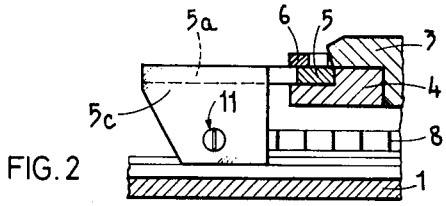
FIG. 2 is an elevational view of a detail of FIG. 1 as viewed from the diametrically opposite side thereof as viewed in FIG. 1.

The regulating device partially represented comprises a balance wheel 1 carried by a shaft 2 rotatably mounted between two bearings, only the upper one 3 of which has been represented. The support for bearing 3, which is forced into the cock 4, constitutes a cock-endstone around which is rotatably mounted a hair-spring carrier 5 on which is superimposed a regulator 6. This regulator is constituted by a thin sheet having a portion **6*a* bent at right angles to provide a slot 7, intended to receive a hair-spring 8, this portion 6*a* thus replacing the usual adjusting pins. The outer end of the hair-spring is secured to the hair-spring carrier 5, which to this end is provided with a thin arm 5*a* having two parallel ears 5*b* and 5*c*, bent at right angles thereto and forming an angle of 15° with the radical plane, designated by 9, passing through the middle portion of the arm 5*a***.

An opening or notch 10 is provided in the ear **5*b* (FIG. 1) for receiving the hair-spring which in this instance is glued thereto by means of a portion of thermoplastic material which is melted by means of a suitable apparatus comprising, generally, heating means operated by electro-resistance and which melts the piece of thermoplastic material in the notch 10**.

Figure 3:
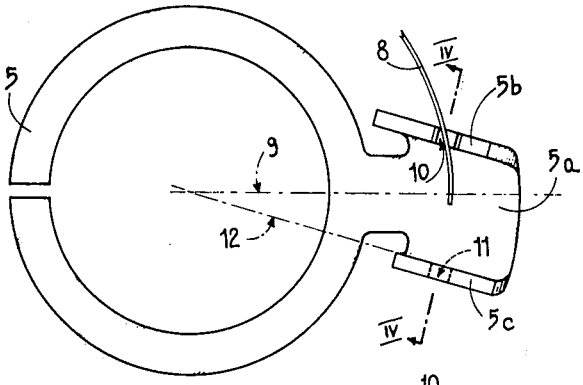
FIG. 3 is a plan view, from underneath, of the hair-spring carrier.
Figure 4:
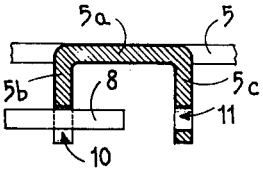
FIG. 4 is a sectional view of this detail, along line IV—IV of FIG. 3.

A second opening 11, which may be example be a circular hole, is provided in ear **5*c* in order to receive the end of hair-spring 8 when it is not to be glued in the notch 10. In that event hair-spring 8 is pinned in hole 11 in the usual manner. It will be noted, however, that in order to ensure proper centering of the hair-spring, it is necessary that the plane of hole 11 be perpendicular to the tangent to the hair-spring at the point where it is fixed to ear 5*c*. As will be seen in FIG. 3, ear 5*c* is disposed in a radial plane 12 through the axis of rotation of the carrier and, therefore, of the hair-spring 8. Consequently, due to the fact that both ears 5*b* and 5*c* form an angle of 15° to the radial plane 9, the arm 5*a* of the hair-spring carrier can be rotated slightly about the cock-endstone 3** in order to reset the mark of the balance wheel when the change is made for gluing the balance wheel to pinning it. This arrangement permits the means for securing the end of the hair-spring to be readily changed without deforming or damaging it.

With the present arrangement, the manufacturer can take advantage of the gluing method of securing the hair-spring, while on the other hand the watch-repairman, who is not equipped to glue hairsprings, can secure the hair-spring by means of a pin.

Figure 5:
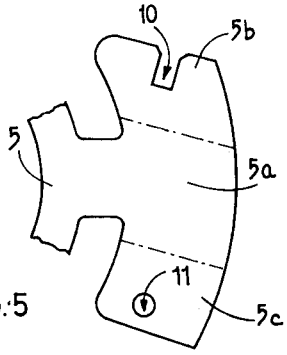
FIG. 5 is a plan view, also from underneath, of this same detail, during the manufacture.

In the example as represented, the hair-spring is secured to a carrier which can be very easily made by a stamping operation giving it the form represented in FIG. 5, and then by bending the ears at right angles to the plane of the carrier arm into parallel relation to each other.

However, the invention is not restricted to the case where a hair-spring carrier is employed. For example, two ears can be provided directly on the cock, one with a notch 10 for gluing the hair-spring, the other with a hole 11 for pinning it.

What I claim is:

1. In a timepiece having a balance wheel, a hair-spring and a support therefor, a securing device for the outer end of said hair-spring comprising a U-shaped arm extending radially of the axis of said balance wheel and having a pair of thin-walled ears disposed parallel to each other and to said axis, said ears being disposed at a predetermined angle to the radial plane through the middle of said arm, one of said ears being provided with a first opening for receiving and fixing the outer end of said hair-spring by gluing it therein, the other of said ears being provided with a second opening for receiving the end of said hair-spring and having a securing pin for fixing it is said second opening when it is not glued in said first opening, said other ear being disposed on a radial plane through the axis of said balance wheel such that the plane of said second opening is perpendicular to the tangent to said hair-spring at the point where it is fixed by said pin.

2. A securing device for a hair-spring a defined in claim 1, wherein said support for said hair-spring comprises a carrier mounted for rotational adjustment about said balance wheel axis for resetting the balance wheel mark when the outer end of said hair-spring is pinned instead of being glued.

* * * * *